US011305856B2

(12) United States Patent
Tejima

(10) Patent No.: US 11,305,856 B2
(45) Date of Patent: Apr. 19, 2022

(54) STEERING APPARATUS FOR OUTBOARD MOTOR

(71) Applicant: SUZUKI MOTOR CORPORATION, Hamamatsu (JP)

(72) Inventor: Shouhei Tejima, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 0 days.

(21) Appl. No.: 17/024,747

(22) Filed: Sep. 18, 2020

(65) Prior Publication Data

US 2021/0122451 A1 Apr. 29, 2021

(30) Foreign Application Priority Data

Oct. 28, 2019 (JP) ..... JP2019-195141

(51) Int. Cl.
*B63H 20/12* (2006.01)
*B63H 20/02* (2006.01)

(52) U.S. Cl.
CPC ..... *B63H 20/12* (2013.01); *B63H 20/02* (2013.01)

(58) Field of Classification Search
CPC ..... B63H 20/12; B63H 20/02
See application file for complete search history.

(56) References Cited

U.S. PATENT DOCUMENTS 3,143,995 A * 8/1964 Koppen ..... B63H 20/12 440/62
4,521,201 A 6/1985 Watanabe
6,174,211 B1 * 1/2001 Nakamura ..... B63H 20/10 440/55

FOREIGN PATENT DOCUMENTS

JP S58145596 A 8/1983
JP 2000053088 A 2/2000

* cited by examiner

*Primary Examiner* — Stephen P Avila
(74) *Attorney, Agent, or Firm* — Holtz, Holtz & Volek PC

(57) ABSTRACT

A steering apparatus for an outboard motor is provided, which stabilizes a steering load of the outboard motor to realize good steering performance, and further is excellent in durability even when a load acts on a steering handle from above. Between a steering bracket (15) and a swivel bracket (14), a steering load adjustment device (20) that adjusts a loaded load to a steering operation following steering of a steering handle (18), and a suspension portion (40) that allows the steering load adjustment device to be supported by the steering bracket are included, and load absorbing portions (44, 22*b*) that absorb a load applied to the steering bracket from above are provided respectively at the suspension portion and the steering load adjustment device.

3 Claims, 6 Drawing Sheets

STEERING APPARATUS FOR OUTBOARD MOTOR

BACKGROUND OF THE INVENTION

Field of the Invention

The present invention relates to a steering apparatus for an outboard motor.

Description of the Related Art

In an outboard motor mounted to a ship, the outboard motor swings around a steering shaft in response to steering to change the traveling direction of the hull. Among the outboard motors in which a ship operator manually operates a steering handle during steering, there is known an outboard motor in which the steering load is made adjustable.

For example, in Japanese Patent Laid-Open No. 2000-53088, a clutch mechanism including an arcuate friction plate and tightening pad portions that sandwich the friction plate from both sides is included, and the tightening pad portions are pressed against the friction plate to increase friction and immobilize the steering bracket to fix the steering angle of the outboard motor.

Japanese Patent Laid-Open No. 58-145596 describes a steering apparatus that releases the lock state when a load of a predetermined value or more is applied onto the steering handle in the lock state where steering is fixed.

In the clutch mechanism in Japanese Patent Laid-Open No. 2000-53088, the friction plate having a large spring constant and is difficult to deform is fixed to the swivel bracket with a bolt. Therefore, followability of the friction plate is bad when a steering operator presses the steering handle down and a load is applied from above, and a change easily occurs to the contact state between the tightening pad portions and the friction plate. In particular, when the load from above is large, there is a problem that the phenomenon occurs, in that the tightening pad portions contact the friction plate having a low ability to follow the load, with one-sided contact, and the steering feeling is likely to change.

The steering apparatus in Japanese Patent Laid-Open No. 58-145596 differs from Japanese Patent Laid-Open No. 2000-53088 in the structure for fixing steering, and there is no suggestion or consideration regarding durability in the case where the tightening pad portions are kept in pressure contact with the friction plate, and in the case where a tilt operation or the like is performed in the lock state and the load of a predetermined value or more acts on the steering handle.

A large space for disposing related components required for steering is often provided between the swivel bracket that supports an outboard motor so that the outboard motor is capable of performing a tilt operation, and the steering bracket that supports the outboard motor to be capable of performing a steering operation. However, even if the steering-related components are attached, there may be room in the space, and the effective use of the space has been a potential issue.

SUMMARY OF THE INVENTION

The present invention is made in the light of the above points, and provides a steering apparatus for an outboard motor that stabilizes a steering load on the outboard motor to realize good steering performance, and is excellent in durability even when a load acts on a steering handle from above.

A steering apparatus for an outboard motor of the present invention includes, a steering load adjustment device that adjusts a loaded load to a steering operation following steering of a steering handle, and a suspension portion that allows the steering load adjustment device to be supported by a steering bracket, wherein the steering load adjustment device and the suspension portion are provided between the steering bracket and a swivel bracket, and wherein load absorbing portions that absorb a load applied to the steering bracket from above are provided respectively at the suspension portion and the steering load adjustment device.

According to the present invention, by providing the load absorbing portions respectively at the suspension portion and the steering load adjustment device, the steering apparatus for an outboard motor is provided, which stabilizes the steering load to realize good steering performance, and further is excellent in durability even when a load acts on the steering handle from above.

The present disclosure relates to subject matter contained in Japanese Patent Application No. 2019-195141 (filed on Oct. 28, 2019) which is expressly incorporated herein by reference in its entirety.

DETAILED DESCRIPTION OF THE PREFERRED EMBODIMENT

Figure 1:
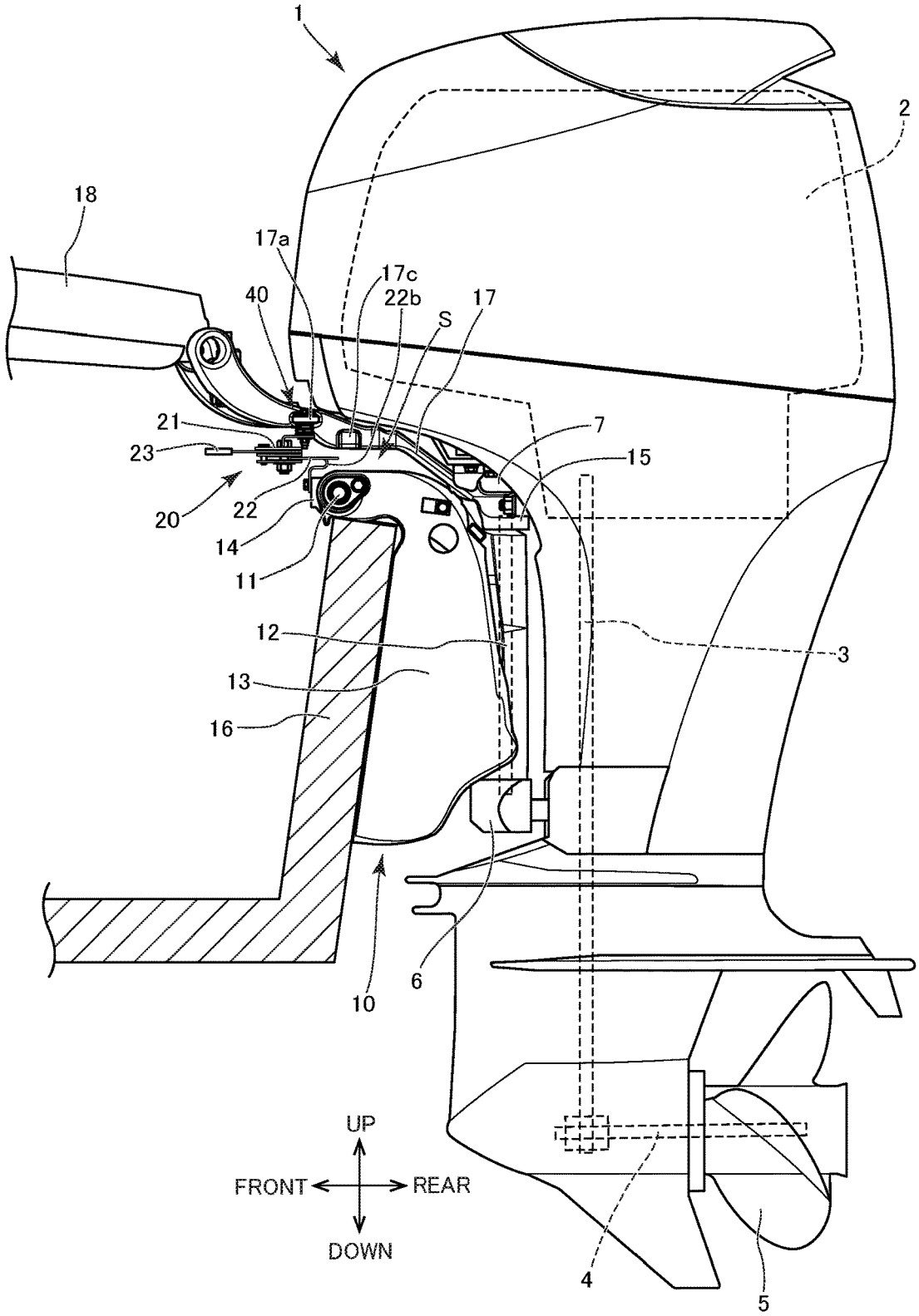
FIG. 1 is a side view of a state where an outboard motor according to a present embodiment is attached to a stern.

Hereinafter, an embodiment of the present invention will be described with reference to the accompanying drawings. As illustrated in FIG. 1, an outboard motor of the present embodiment includes an outboard motor main body 1 and a mounting device 10. In the following explanation and respective drawings, a direction in which a drive shaft 3 described later extends is defined as an up-down direction of the outboard motor, and a direction in which a propeller shaft 4 extends is defined as a front-rear direction of the outboard motor. In the front-rear direction, a front is a hull side, and a rear is an outboard motor side. A direction perpendicular to the up-down direction and the front-rear direction is defined as a width direction (left-right direction) of the outboard motor. In the width direction, a right hand side to the hull side is a right side, and a left hand side is a left side.

As illustrated in FIG. 1, the outboard motor main body 1 transmits rotation from an output shaft of an engine 2 disposed in an engine room at an upper part to the propeller shaft 4 via the drive shaft 3, and rotates a propeller 5 provided at a rear end of the propeller shaft 4. A propulsive force is generated by rotation of the propeller 5.

The outboard motor main body 1 is mounted to a stern part of the hull via the mounting device 10. In a state mounted to the hull by the mounting device 10, a tilt operation to swing the outboard motor main body 1 back and forth around a tilt shaft 11 extending in the width direction, and a steering operation (steering) to swing the outboard motor main body 1 left and right around a steering shaft 12 extending in the up-down direction can be performed. Accordingly, respective directions of up and down, front and rear, and left and right (width) in the outboard motor may not correspond to respective directions of up and down, front and rear, and left and right (width) in the hull.

Figure 5:
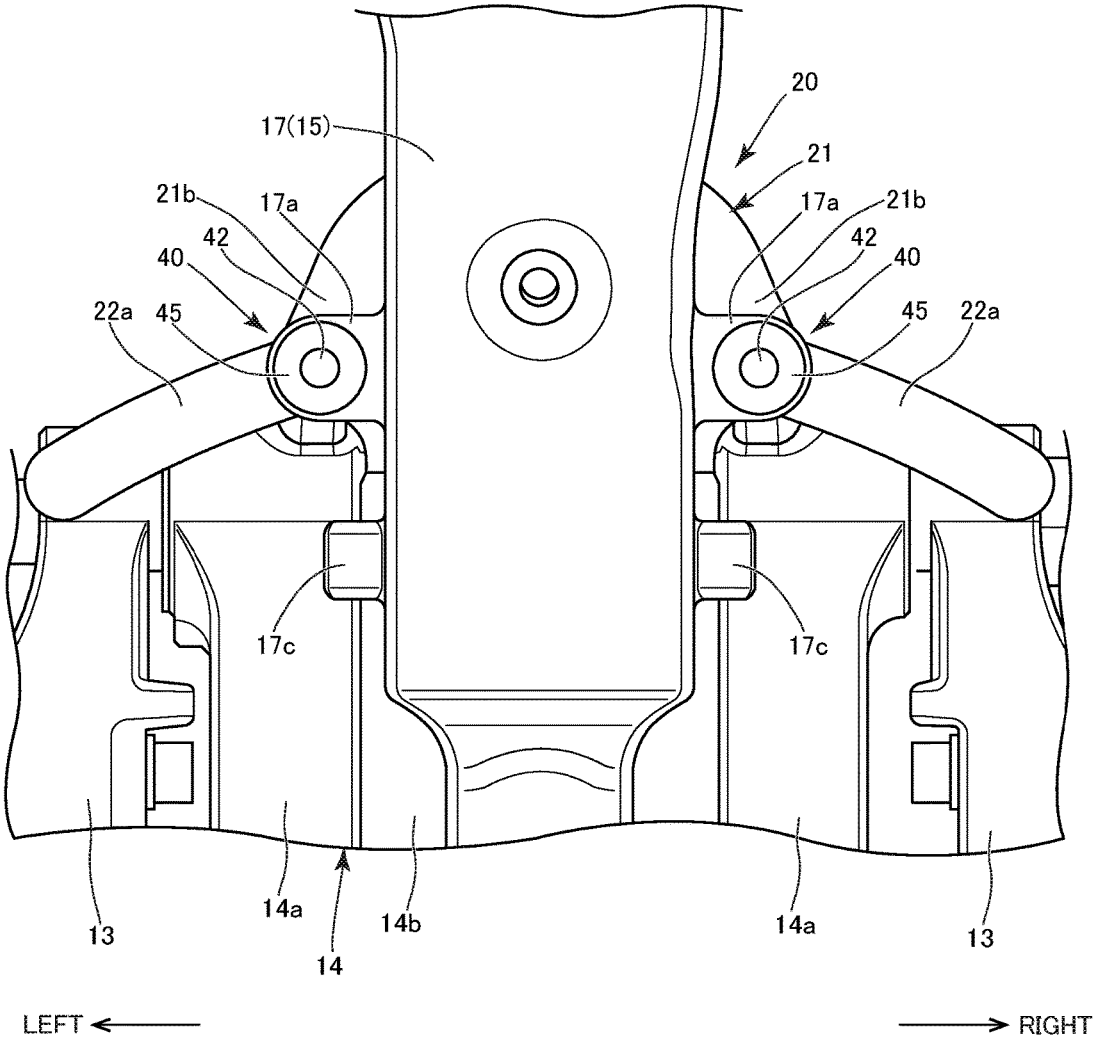
FIG. 5 is a top view of the steering apparatus in a vicinity of the steering load adjustment device.
Figure 6:
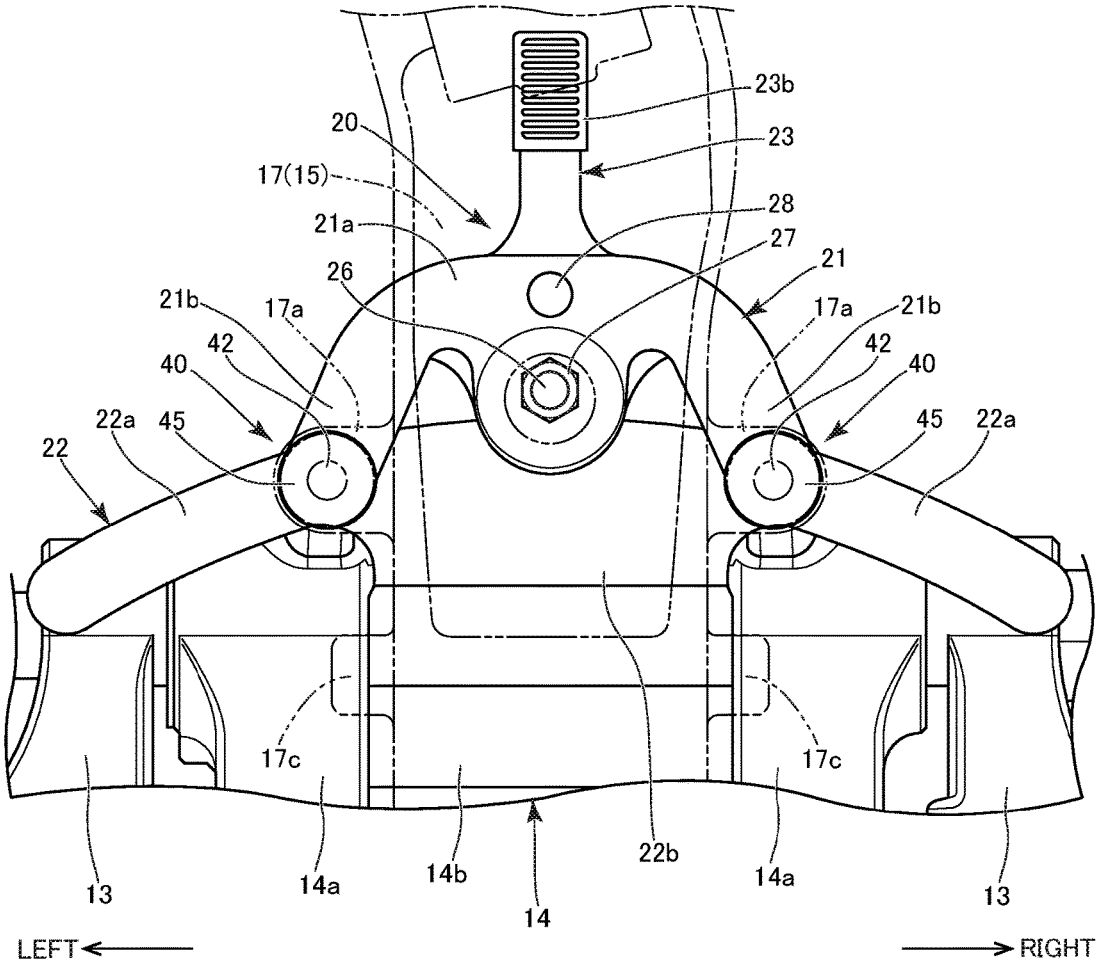
FIG. 6 is a top view of the steering apparatus illustrated by seeing through the steering bracket.

As illustrated in FIG. 1, FIG. 5, and FIG. 6, the mounting device 10 includes a clamp bracket 13, a swivel bracket 14 and a steering bracket 15. Note that the up-down direction in explanation of the mounting device 10 means an up-down direction in an initial state illustrated in each of the drawings. In other words, according to the tilt operation, angles of parts other than the clamp bracket 13 of the mounting device 10 change to the hull, but respective parts of the mounting device 10 will be described with a state where the drive shaft 3 is oriented to the vertical direction without performing an angle change like this.

The clamp bracket 13 is fixed to a transom 16 provided at the stern of the hull. As illustrated in FIG. 5 and FIG. 6, the clamp bracket 13 has a pair of left and right support portions that are provided separately in the width direction, and the swivel bracket 14 is disposed between the pair of support portions of the clamp bracket 13. The swivel bracket 14 has a pair of left and right supported portions 14*a* along the pair of support portions of the clamp bracket 13, and has a recessed portion 14*b* in a shape recessed downward, on a top surface between the pair of supported portions 14*a*. Related components (a link member and cables that are not illustrated) required for steering are disposed in the recessed portion 14*b*. A pair of left and right shaft support holes that are penetrated in the width direction are formed in the pair of support portions of the clamp bracket 13, and a tilt shaft 11 is supported in the shaft support holes (see FIG. 2).

Shaft holes through which the tilt shaft 11 is inserted are formed in the pair of supported portions 14*a* of the swivel bracket 14, and the swivel bracket 14 is supported swingably around the tilt shaft 11. When a drive force is applied to the swivel bracket 14 by a tilt cylinder not illustrated, the swivel bracket 14 swings around the tilt shaft 11. Thereupon, the outboard motor main body 1 that is connected to the swivel bracket 14 via the steering bracket 15 and the steering shaft 12 performs a forward tilting operation (tilt up) to pull the propeller 5 upward, and a backward tilting operation (tilt down) to lower the propeller 5.

A steering shaft hole that is penetrated in the up-down direction is formed in the swivel bracket 14, and the steering shaft 12 is inserted into the steering shaft hole. The steering shaft 12 is supported rotatably around an axial line facing the up-down direction to the steering shaft hole. A lower end of the steering shaft 12 protrudes downward from the steering shaft hole in the swivel bracket 14, and is fixed to the outboard motor main body 1 via a mount portion 6.

An upper end of the steering shaft 12 protrudes upward from the steering shaft hole of the swivel bracket 14, and the steering bracket 15 is attached to a protruded portion of the steering shaft 12. The steering bracket 15 is in a relationship in which the steering bracket 15 swings integrally with the steering shaft 12. The steering bracket 15 is fixed to the outboard motor main body 1 via a mount portion 7.

The steering bracket 15 includes an arm portion 17 that is provided to extend forward from a part that connects to the steering shaft 12. The arm portion 17 has a long and narrow shape passing above the swivel bracket 14. A space S with a predetermined gap in the up-down direction is formed between the swivel bracket 14 and the arm portion 17. In a vicinity of the tilt shaft 11, a top surface of the swivel bracket 14 and an undersurface of the arm portion 17 are substantially parallel, and face each other with the space S therebetween. As illustrated in FIG. 1, the arm portion 17 extends forward relative to the swivel bracket 14, and a steering handle 18 which a ship operator operates during steering is connected to a front end portion of the arm portion 17.

An operation of the mounting device 10 configured as above will be described. A tilt operation of the outboard motor main body 1 to cause the outboard motor main body 1 to swing back and forth around the tilt shaft 11 is performed by drive of the tilt cylinder that operates by hydraulic pressure. A steering operation of the outboard motor main body 1 that causes the outboard motor main body 1 to swing left and right around the steering shaft 12 is performed by a manual operation of the steering handle 18. When the ship operator turns the steering handle 18 left and right, the steering bracket 15 and the steering shaft 12 integrally swing, and the outboard motor main body 1 in a fixed relation with the steering bracket 15 and the steering shaft 12 swing left and right. As a result, a traveling direction of the hull changes.

The steering apparatus for the outboard motor includes a steering load adjustment device 20 that adjusts a loaded load of the steering operation, between the swivel bracket 14 and the steering bracket 15. A main part of the steering load adjustment device 20 is located in front of the space S between the top surface of the swivel bracket 14 and the undersurface of the arm portion 17, and a part of the steering load adjustment device 20 (a load absorbing portion 22*b* described later) is located in the space S. The steering load adjustment device 20 has a support plate 21, a friction plate 22, an operation member 23, a pair of pad members 24 and 25, and a shaft bolt 26. The steering load adjustment device 20 is supported by the arm portion 17 via a pair of left and right suspension portions 40.

As illustrated in FIG. 5 and FIG. 6, the support plate 21 has a base portion 21*a*, and a pair of extension portions 21*b* that are in a bifurcated shape from the base portion 21*a* to extend rearward. The arm portion 17 of the steering bracket 15 has a pair of sideward protrusion portions 17*a* that protrude left and right. The pair of sideward protrusion portions 17*a* and the pair of extension portions 21*b* are connected respectively via the suspension portions 40, and the support plate 21 swings with the steering bracket 15.

Figure 2:
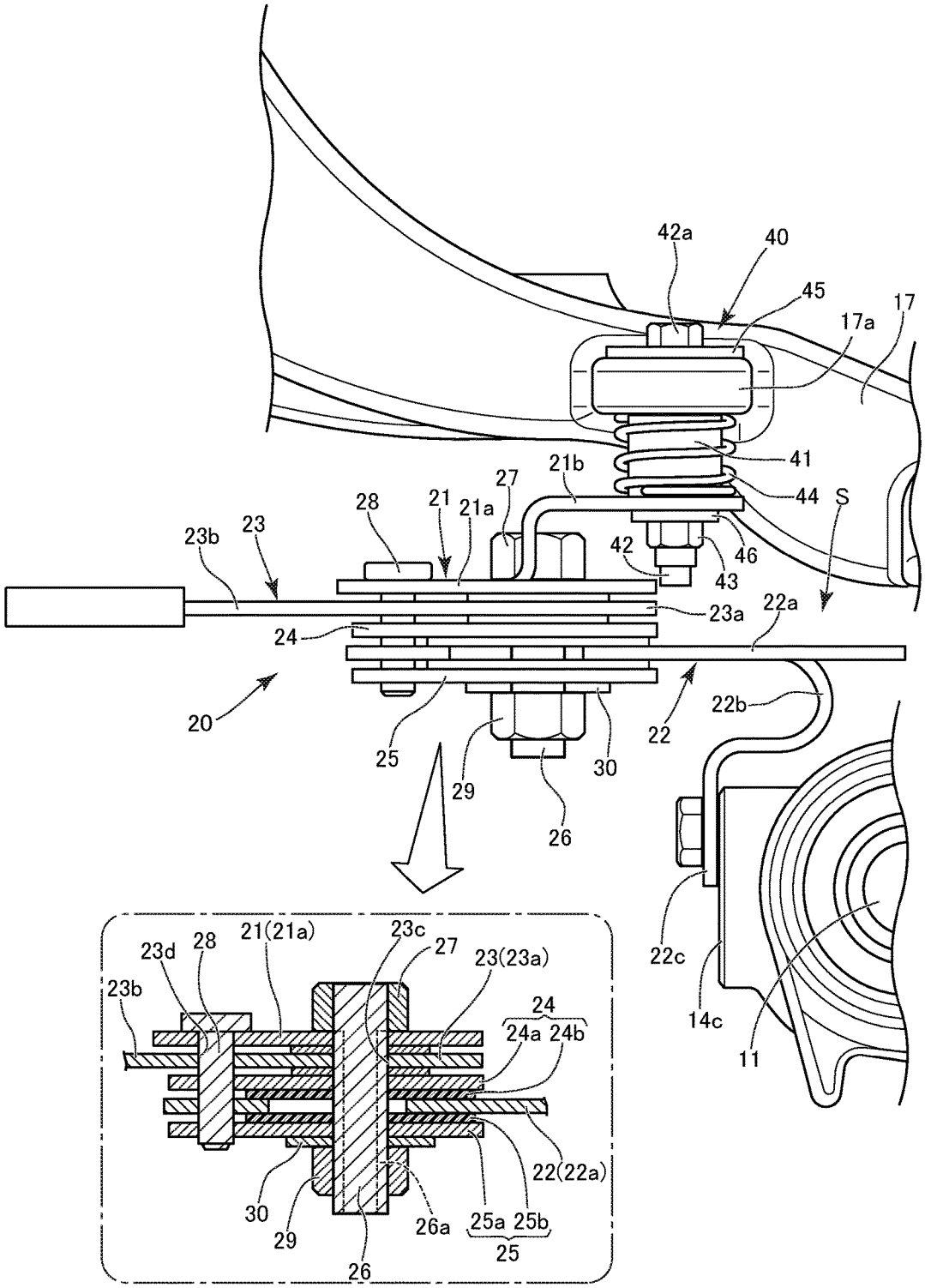
FIG. 2 is a side view of a steering load adjustment device configuring a steering apparatus for the outboard motor and a vicinity of the steering load adjustment device.
Figure 3:
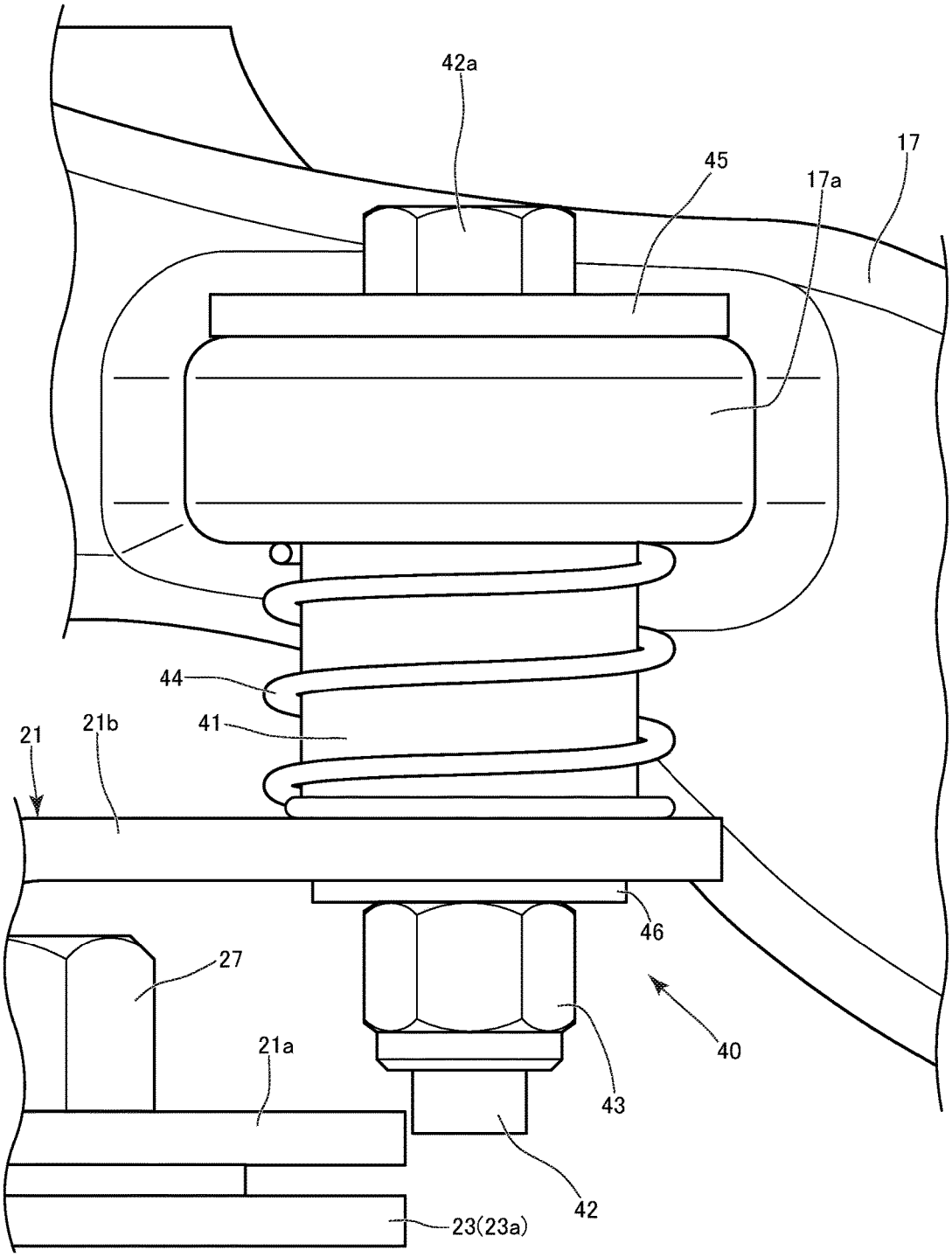
FIG. 3 is a side view of a suspension portion that allows the steering load adjustment device to be supported by a steering bracket.
Figure 4:
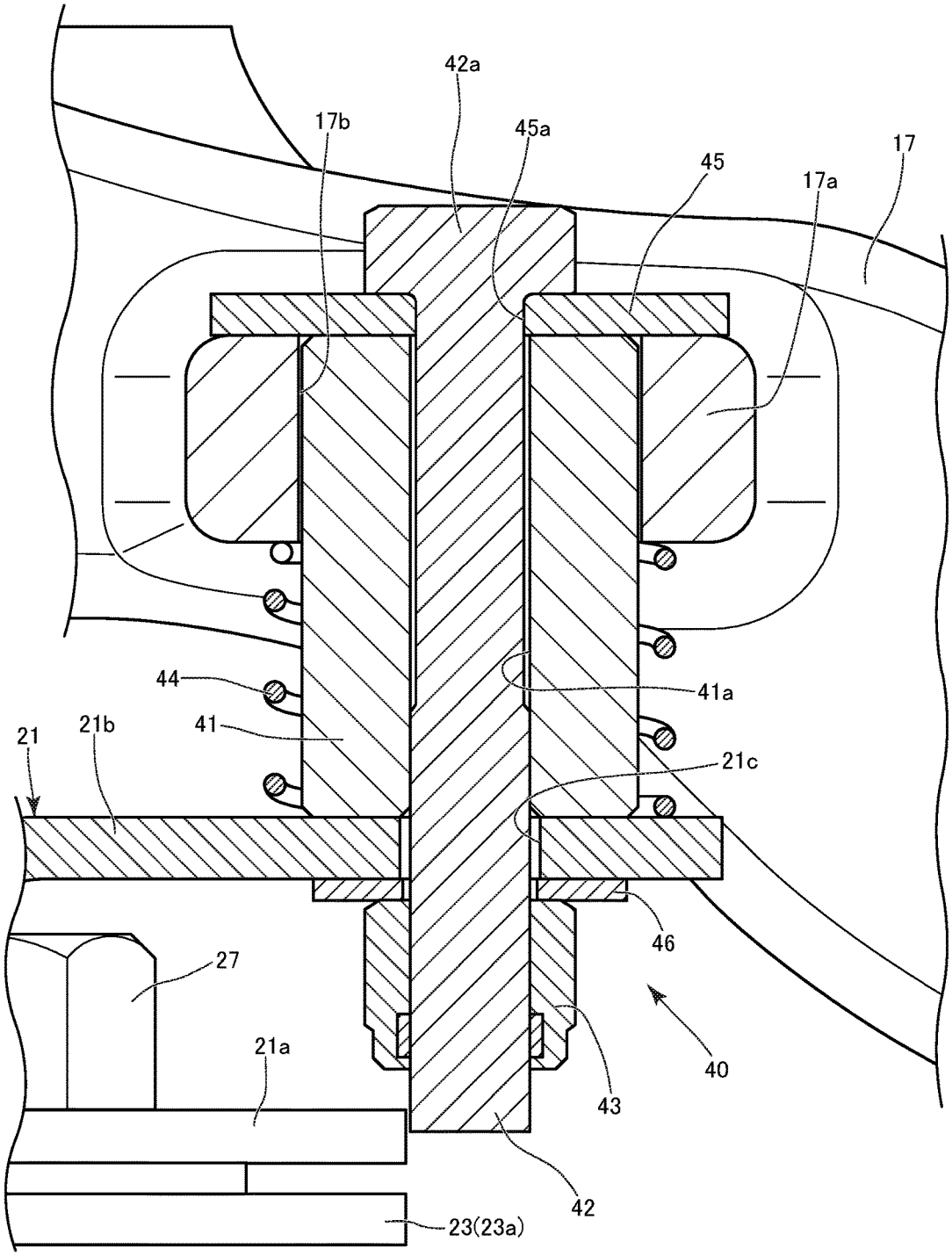
FIG. 4 is a sectional view of the suspension portion.

While FIG. 2 to FIG. 4 illustrate the suspension portion 40 on a left side, the suspension portion 40 on a right side also has a similar configuration. The left and right suspension portions 40 each includes a shaft member 41, a bolt 42, a nut 43, and a spring 44. A through-hole 17*b* that is penetrated in the up-down direction is formed in the sideward protrusion portion 17*a* of the arm portion 17. The shaft member 41 is a cylindrical member that is inserted into the through-hole 17*b* to protrude downward of the sideward protrusion portion 17*a*, and a bolt insertion hole 41*a* is formed inside the shaft member 41. In the extension portion 21*b* of the support plate 21, a through-hole 21*c* communicating with the bolt insertion hole 41*a* is formed.

A tightening plate 45 is supported on a top surface of the sideward protrusion portion 17*a*. An upper end of the shaft member 41 abuts on the tightening plate 45, and a lower end of the shaft member 41 abuts on the extension portion 21*b* of the support plate 21. The bolt 42 is inserted into a through-hole 45*a* of the tightening plate 45, the bolt insertion hole 41*a* of the shaft member 41, and the through-hole 21*c* of the extension portion 21*b*. The bolt 42 is restricted from being inserted at a position where a head portion 42*a* abuts on the tightening plate 45. In this state, a tip end of the bolt 42 protrudes downward of the extension portion 21*b* to be screwed into the nut 43. The nut 43 abuts on a washer 46, and the washer 46 abuts on an undersurface of the extension portion 21*b*.

A spring 44 is disposed between the sideward protrusion portion 17*a* and the extension portion 21*b*. The spring 44 is a compression coil spring that surrounds an outer peripheral surface of the shaft member 41, is compressed and deformed when the bolt 42 is fastened to the nut 43, and generates an urging force in a direction to separate the sideward protrusion portion 17*a* and the extension portion 21*b*. By the urging force, a state where the sideward protrusion portion 17*a* abuts on the tightening plate 45 from below (FIG. 2 to FIG. 4) is a normal state.

An upper nut 27 and a restriction pin 28 are provided at the base portion 21*a* of the support plate 21. The upper nut 27 and the restriction pin 28 are respectively fixed to the support plate 21 by welding or the like, the restriction pin 28 is located close to a front edge of the base portion 21*a*, and the upper nut 27 is located behind the restriction pin 28. The upper nut 27 is located on a top surface of the base portion 21*a*, and has a screw hole inside. In the base portion 21*a*, a through-hole that communicates with the screw hole of the upper nut 27 is formed. The restriction pin 28 has a columnar shape protruding downward from the base portion 21*a*.

As illustrated in FIG. 2, the shaft bolt 26 is inserted into the screw hole of the upper nut 27. The shaft bolt 26 has a screw formed on an outer peripheral surface of a columnar shaft portion, and has a pair of parallel side planes 26*a* extending in an axial direction. No screw is formed on the side planes 26*a*. The shaft bolt 26 is screwed in the screw hole of the upper nut 27.

The friction plate 22 has an arc plate portion 22*a*, the load absorbing portion 22*b*, and the support plate portion 22*c*. The arc plate portion 22*a* is a plate-shaped portion in an arc shape in which a central portion in the width direction protrudes most forward, and curves rearward toward the left and the right from the central portion.

As illustrated in FIG. 2, the load absorbing portion 22*b* is formed into a U-shape to the rear (outboard motor main body 1 side) as viewed from a lateral side of the outboard motor. The load absorbing portion 22*b* protrudes rearward from the central portion in the width direction of the arc plate portion 22*a*, is folded back forward while curving downward above the tilt shaft 11, and is located in the space S between the swivel bracket 14 and the arm portion 17. The load absorbing portion 22*b* (in more detail, an upper side portion and a lower side portion except for a curved tip end of the U-shape) is substantially parallel with an upper portion of the swivel bracket 14 and a lower portion of the arm portion 17 that face each other with the space S therebetween.

The support plate portion 22*c* is formed by being bent further downward from the load absorbing portion 22*b*. As illustrated in FIG. 2, a pair of left and right mounting portions 14*c* are provided at a front end portion of the swivel bracket 14, and the support plate portion 22*c* is fixed to the mounting portions 14*c* from a front with bolts. In other words, the friction plate 22 is supported by the swivel bracket 14 with a cantilever structure having the support plate portion 22*c* as a base end. The friction plate 22 is configured to be easily deformed (spring constant is small) to a load from above in a location of the load absorbing portion 22*b*.

The operation member 23 has a base portion 23*a* that is located on an undersurface side of the base portion 21*a* of the support plate 21, and a gripping portion 23*b* extending forward from the base portion 23*a*. A fitting hole 23*c* is formed in the base portion 23*a*. The fitting hole 23*c* is a hole in a noncircular shape including linear portions corresponding to the side planes 26*a* of the shaft bolt 26, and is fitted to the shaft bolt 26 in a state where rotation is restricted. When the gripping portion 23*b* is swung left and right, the operation member 23 rotates with the shaft bolt 26.

An operation restricting long hole 23*d* (part thereof is illustrated in sectional view in FIG. 2) is further formed in the base portion 23*a* of the operation member 23. The operation restricting long hole 23*d* has an arc shape with the fitting hole 23*c* as a center. The restriction pin 28 is inserted into the operation restricting long hole 23*d*. The restriction pin 28 abuts on an end portion of the operation restricting long hole 23*d*, and thereby a swing range of the operation member 23 is restricted.

The pad member 24 and the pad member 25 are provided in a relationship in which the pad member 24 and the pad member 25 sandwich the arc plate portion 22*a* of the friction plate 22 from above and below. The pad member 24 is configured by a pad holding plate 24*a*, and a friction pad 24*b* provided on an undersurface of the pad holding plate 24*a*, and is located between the base portion 23*a* and the arc plate portion 22*a* (under the base portion 23*a*, over of the arc plate portion 22*a*). The pad member 25 is configured by a pad holding plate 25*a*, and a friction pad 25*b* provided on a top surface of the pad holding plate 25*a*, and is located under the arc plate portion 22*a*. The friction pad 24*b* and the friction pad 25*b* are friction members having a predetermined friction coefficient. The pad member 24 and the pad member 25 swing with the support plate 21 and the steering bracket 15 via the shaft bolt 26, and are further movable up and down along the shaft bolt 26.

The shaft bolt 26 that is screwed into the screw hole of the upper nut 27 and is fitted in the fitting hole 23*c* further extends downward, penetrates through the pad member 24 and the pad member 25 to protrude downward, and is screwed into a screw hole of a lower nut 29. The lower nut 29 abuts on a washer 30 contacting an undersurface of the pad holding plate 25*a* from below.

In the steering load adjustment device 20 of the above configuration, a frictional force (friction resistance) acting between the pad member 24 and the pad member 25, and the friction plate 22 changes according to a degree of fastening of the lower nut 29 to the shaft bolt 26. The steering load of the steering bracket 15 is adjusted by a change in the frictional force of the pad member 24 and the pad member 25 to the friction plate 22 supported by a swivel bracket 14 side.

In an initial state of the steering load adjustment device 20, setting is made so that the friction pad 24*b* of the pad member 24 and the friction pad 25*b* of the pad member 25 contact the arc plate portion 22*a* lightly to apply appropriate resistance feeling, and swing of the steering bracket 15 around the steering shaft 12, that is, steering of the steering handle 18 can be freely performed.

When the gripping portion 23*b* is gripped and the operation member 23 is rotated in a tightening direction, a force to narrow a space between the support plate 21 and the lower nut 29 is applied, the friction pad 24*b* and the friction pad 25*b* come into pressure contact with the arc plate portion 22*a* from both sides of the arc plate portion 22*a*, and rotation resistance between the support plate 21 and the friction plate 22 increases by friction. Thereby, a steering load of the steering bracket 15 to which the support plate 21 is mounted increases. Conversely, when the operation member 23 is rotated in an opposite direction to the tightening direction, the frictional force to the friction plate 22 decreases, and the steering load of the steering bracket 15 decreases. The steering load can be properly changed according to the rotation direction and an operation amount of the operation member 23. Further, when the operation member 23 is rotated to a predetermined position in the tightening direction, a steering angle of the steering bracket 15 can be brought into a fixed state by friction engagement. The arc plate portion 22*a* is in an arc shape along a movement trajectory of the pad member 24 and the pad member 25 when the steering bracket 15 swings around the steering shaft 12, and therefore can arbitrarily adjust the steering load of the steering bracket 15 at a desired steering angle.

Incidentally, a load from an upper side to a lower side may be applied to the steering load adjustment device 20 by the ship operator pressing down the steering handle 18. As illustrated in FIG. 1, the arm portion 17 and the steering handle 18 extend long forward from a position axially supported by the steering shaft 12, and when the steering handle 18 is pressed down from above, a large load easily acts on a part corresponding to the steering load adjustment device 20.

In the steering apparatus of the present embodiment, it is possible to absorb a load by the suspension portion 40 when a large load is applied downward from above. When a load is applied to the steering handle 18 or the like from above, the sideward protrusion portion 17*a* of the arm portion 17 displaces downward. At this time, the through-hole 17*b* of the sideward protrusion portion 17*a* slides in contact with an outer peripheral surface of the shaft member 41, so that the shaft member 41 and the support plate 21 (extension portion 21*b*) below the shaft member 41 are not pushed down directly, but only the sideward protrusion portion 17*a* moves downward while increasing bending of the spring 44. During this operation, it is possible to absorb the load by deformation of the spring 44 without affecting a positional relationship between the support plate 21 and the friction plate 22. In other words, the spring 44 functions as a load absorbing portion in the suspension portion 40, and can absorb the load from above without changing the contact condition of the arc plate portion 22*a* of the friction plate 22, and the pad member 24 and the pad member 25.

Further, in the steering load adjustment device 20, as a component easy to deform (spring constant is small) to the load from above, the load absorbing portion 22*b* is provided at the friction plate 22. When the suspension portion 40 receiving the load from above reaches a flection limit of the spring 44, the load is also transmitted to the support plate 21. When a large load of a predetermined value or more like this is applied, the load absorbing portion 22*b* that is provided as a portion having a small spring constant, of the friction plate 22 deforms and absorbs the load. Since the load absorbing portion 22*b* preferentially deforms, followability of the arc plate portion 22*a* to the positional change in the up-down direction of the pad member 24 and the pad member 25 is improved. As a result, a change in contact state of the arc plate portion 22*a* and the pad member 24 and the pad member 25, that is, a change in steering load is suppressed.

A spring constant of the spring 44 that is a load absorbing portion in the suspension portion 40 is smaller than the spring constant of the load absorbing portion 22*b* of the friction plate 22. Accordingly, when a large load is applied to the steering apparatus including the steering bracket 15 from above, load absorption (deformation) in the spring 44 of the suspension portion 40 having a small spring constant is performed first, and when the load absorption in the suspension portion 40 reaches a limit, load absorption (deformation) in the load absorbing portion 22*b* of the friction plate 22 is performed.

In this way, the suspension portion 40 is provided at the portion where the steering load adjustment device 20 is supported by the steering bracket 15 (arm portion 17), and the load absorbing portion that absorbs a load from above is included in each of the suspension portion 40 and the friction plate 22. Thereby, a change in steering feeling due to load input from outside that is different from the operation of the operation member 23 is prevented, the steering load is stabilized and excellent steering performance can be secured. Since load absorption is performed in two stages that are the suspension portion 40 and the friction plate 22, it is possible to obtain high durability and excellent load resistance performance.

Further, since the spring constants of the spring 44 and the load absorbing portion 22*b* are made different, and a load is reduced preferentially in the suspension portion 40 before the load is exerted on the friction plate 22, it is possible to improve followability of the friction plate 22 to the change in the up-down direction of the pad member 24 and the pad member 25, and prevent a change in steering feeling more reliably.

The suspension portions 40 are provided at both the left and right sides of the arm portion 17, so that even when a load is applied from a direction inclined to some extent, it is possible to absorb the load efficiently and reliably by making deformation amounts of the springs 44 different from each other in the left and right suspension portions 40.

The load absorbing portion 22*b* protrudes rearward (outboard motor main body 1 side) from the arc plate portion 22*a*, and is in the U-shape located in the space S between the swivel bracket 14 and the arm portion 17 of the steering bracket 15. In more detail, the tip end (rearward end portion of the U-shape) of the load absorbing portion 22*b* is located above the tilt shaft 11. In the space S between the swivel bracket 14 and the steering bracket 15, related components required for steering (link member and cables not illustrated) are provided, and the load absorbing portion 22*b* is disposed with the steering related components by effectively using the space S. Accordingly, it is possible to absorb the load applied to the steering load adjustment device 20 and stabilize the steering load by the configuration excellent in space efficiency.

In the suspension portion 40, adjustment of the load absorbing performance is possible by change of the length of the shaft member 41, and change to the spring 44 with a different spring force.

Easiness of deformation of the load absorbing portion 22*b* of the friction plate 22 can be properly set according to a shape, plate thickness and the like thereof. For example, the spring constant may be decreased by forming a lightening portion in a central portion of the load absorbing portion 22*b*. Thereby, it is possible to change followability of the friction plate 22 at the time of the load of a magnitude of the load absorbed by the suspension portion 40 or more being applied.

As illustrated in FIG. 5, at the arm portion 17 of the steering bracket 15, a pair of left and right stopper bosses 17*c* are provided rearward (outboard motor main body 1 side) of the pair of left and right sideward protrusion portions 17*a*. The stopper bosses 17*c* protrude sideward from the arm portion 17, and a space between the pair of stopper bosses 17*c* is larger than a width of the recessed portion 14*b* of the swivel bracket 14. Accordingly, when the arm portion 17 is seen in top view, the pair of stopper bosses 17*c* are in a relationship in which the pair of stopper bosses 17*c* overlap the pair of supported portions 14*a* (the respective stopper bosses 17*c* are located above the respective supported portions 14*a*), as illustrated in FIG. 6.

When the arm portion 17 of the steering bracket 15 displaces by a predetermined amount or more by the load from above, the stopper bosses 17*c* abut on top surfaces of the supported portions 14*a* of the swivel bracket 14, and restrict further movement of the arm portion 17. Abutment of the stopper bosses 17*c* onto the swivel bracket 14 is set so as to occur after operations of load absorption by respective deformations of the spring 44 of the suspension portion 40 and the load absorbing portion 22*b* of the friction plate 22 are performed. Accordingly, the stopper bosses 17*c* function as the load receiving portions that abut on the swivel bracket 14 from above, and can protect the steering load adjustment device 20 without exerting the load of a predetermined value or more onto the suspension portion 40 and the friction plate 22.

As illustrated in FIG. 5 and FIG. 6, the stopper bosses 17*c* are located rearward (outboard motor main body 1 side) from the suspension portion 40 and the load absorbing portion 22*b* of the friction plate 22. When a load is applied to the steering handle 18 and the steering bracket 15 (arm portion 17) from above, the steering bracket 15 tends to tilt in a direction to bring the arm portion 17 closer to the swivel bracket 14, with a spot (steering shaft hole) at which the steering shaft 12 receives support of the swivel bracket 14 as a support point. By providing the stopper bosses 17*c* rearward from the suspension portions 40 and the load absorbing portions 22*b* of the friction plate 22, the stopper bosses 17*c* abut on the supported portions 14*a* of the swivel bracket 14 in a position closer to the steering shaft 12, and therefore, an effect of decreasing a tilt amount of the steering bracket 15 to reduce the load exerted on the suspension portion 40 and the steering load adjustment device 20 can be obtained.

As described above, in the steering apparatus for an outboard motor of the present embodiment, the suspension portion 40 that allows the steering load adjustment device 20 to be supported by the steering bracket 15 (arm portion 17), and the friction plate 22 configuring the steering load adjustment device 20 respectively include the load absorbing portions (the spring 44, the load absorbing portion 22*b*) that absorb the load from above. Thereby, the steering load of the outboard motor is stabilized and good steering performance with little change in steering feeling is realized, and further, durability to the load that acts from above can be improved.

The spring 44 of the suspension 40 and the load absorbing portion 22*b* of the friction plate 22 respectively have large degrees of freedom of setting spring constants, and easily realize improvement in steering feeling by enhancing followability of the friction plate 22 to the load from above.

The suspension portions 40 are disposed by effectively using the spaces on the left and right of the arm portion 17, the shaft members 41 are inserted through the pair of left and right sideward protrusion portions 17*a* that protrude from the arm portion 17, and the springs 44 are assembled to the outsides of the shaft members 41. Further, the load absorbing portion 22*b* of the friction plate 22 is disposed by effectively using the space S between the swivel bracket 14 and the steering bracket 15. Accordingly, in each of the suspension portion 40 and the steering load adjustment device 20, absorption of the load from above is realized by the simple configuration excellent in space efficiency.

Note that the present invention can be carried out by being variously changed without being limited to the above described embodiment. In the above described embodiment, it is possible to properly change the dimensions, shapes and the like illustrated in the accompanying drawings within the range in which the effect of the present invention is exhibited without being limited to the dimensions, shapes and the like illustrated in the accompanying drawings. In addition, it is possible to carry out the present invention by properly changing the present invention within the range without departing from the object of the present invention.

For example, as the load absorbing portion in the suspension portion 40, other types of springs such as a plate spring, and an elastic body such as rubber may be used other than the compression coil spring like the spring 44.

The load absorbing portion of the friction plate 22 is not limited to the U-shape like the load absorbing portion 22*b*, but may be in a different shape as long as the load absorbing portion can efficiently absorb the load from above.

The steering apparatus for an outboard motor of the present invention has an effect of stabilizing the steering load of the outboard motor to realize good steering performance, and further being excellent in durability even when a load acts on the steering handle from above, and is particularly useful for the outboard motor of the structure in which a load from above is easily applied to the steering apparatus.

REFERENCE SIGNS LIST

1: outboard motor main body
10: mounting device
11: tilt shaft
12: steering shaft
13: clamp bracket
14: swivel bracket
14*a*: supported portion
14*b*: recessed portion
15: steering bracket
17: arm portion
17*a*: sideward protrusion portion
17*c*: stopper boss (load receiving portion)
18: steering handle
20: steering load adjustment device
21: support plate
22: friction plate
22*a*: arc plate portion
22*b*: load absorbing portion (load absorbing portion of steering load adjustment device)
23: operation member
24: pad member
24*b*: friction pad
25: pad member
25*b*: friction pad
26: shaft bolt
40: suspension portion
41: shaft member
42: bolt
44: spring (load absorbing portion of suspension portion)

What is claimed is:

1. A steering apparatus for an outboard motor, the steering apparatus comprising:

a steering load adjustment device that adjusts a loaded load to a steering operation following steering of a steering handle; and a suspension portion that allows the steering load adjustment device to be supported by a steering bracket, wherein the steering load adjustment device and the suspension portion are provided between the steering bracket and a swivel bracket, wherein load absorbing portions that absorb a load applied to the steering bracket from above are provided respectively at the suspension portion and the steering load adjustment device, and wherein a spring constant of the load absorbing portion of the suspension portion is smaller than a spring constant of the load absorbing portion of the steering load adjustment device.

2. The steering apparatus according to claim 1, further comprising a load receiving portion at the steering bracket, wherein the load receiving portion abuts on the swivel bracket from above, and prevents a load of at least a predetermined value from being applied to the suspension portion and the steering load adjustment device.

3. The steering apparatus according to claim 2, wherein the load receiving portion is located closer to an outboard motor main body than the load absorbing portion of the steering load adjustment device.

* * * * *